US010306385B2

(12) United States Patent
Kennes et al.

(10) Patent No.: US 10,306,385 B2
(45) **Date of Patent: *May 28, 2019**

(54) PASSIVE VIBRATION CANCELLATION SYSTEM FOR MICROPHONE ASSEMBLY

(71) Applicant: COCHLEAR LIMITED, Macquarie University (AU)

(72) Inventors: Patrik Kennes, Macquarie University (AU); James Vandyke, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/413,679

(22) Filed: Jan. 24, 2017

(65) Prior Publication Data

US 2017/0238105 A1 Aug. 17, 2017

Related U.S. Application Data

(63) Continuation of application No. 14/323,105, filed on Jul. 3, 2014, now Pat. No. 9,591,416.

(51) Int. Cl.

| | |
|---|---|
| ***H04R 1/08*** | (2006.01) |
| ***H04R 9/08*** | (2006.01) |
| ***H04R 25/00*** | (2006.01) |
| ***H04R 1/44*** | (2006.01) |
| ***H04R 1/02*** | (2006.01) |
| ***H04R 1/28*** | (2006.01) |

(52) U.S. Cl.

CPC ..... *H04R 25/65* (2013.01); *H04R 1/023* (2013.01); *H04R 1/2884* (2013.01); *H04R 1/44* (2013.01); *H04R 2225/021* (2013.01); *H04R 2225/67* (2013.01); *H04R 2460/13* (2013.01)

(58) Field of Classification Search

CPC . H04R 1/08; H04R 9/08; H04R 11/04; H04R 17/02; H04R 21/02; H04R 1/086; H04R 1/02; H04R 1/105

USPC ..... 381/355–361, 365, 368–369

See application file for complete search history.

(56) References Cited

U.S. PATENT DOCUMENTS

| | | | | |
|---|---|---|---|---|
| 4,511,768 | A | 4/1985 | Patel | |
| 4,837,836 | A | 6/1989 | Barcus | |
| 5,574,794 | A | 11/1996 | Valley | |
| 5,684,880 | A | 11/1997 | Lazzeroni | |
| 7,471,802 | B2 * | 12/2008 | Akino | H04R 1/086 381/334 |
| 8,467,551 | B2 | 6/2013 | Turnbull | |
| 9,218,800 | B2 * | 12/2015 | Kawakami | D04H 1/46 |
| 9,294,832 | B2 * | 3/2016 | Suvanto | H04R 3/005 |
| 9,467,760 | B2 * | 10/2016 | Kawakami | H04R 1/086 |

(Continued)

*Primary Examiner* — Suhan Ni

(74) *Attorney, Agent, or Firm* — Merchant & Gould P.C.

(57) ABSTRACT

A passive vibration cancellation system manufactured of a plurality of waterproof diaphragms and a more rigid support structure is sized to cover a microphone of an auditory prosthesis. The system includes multiple flexible diaphragms that deform in opposite directions when acted upon by sound, but deform in the same direction when acted upon by vibrations. The system can further include a collar or other compliant element to help secure a microphone assembly into the auditory prosthesis housing, while further reducing vibration transmission between the housing and the microphone.

20 Claims, 15 Drawing Sheets

(56) References Cited

U.S. PATENT DOCUMENTS

| | | | |
|---|---|---|---|
| 2010/0208930 | A1 | 8/2010 | Kopnov |
| 2011/0103634 | A1 | 5/2011 | Maddern |

* cited by examiner

PASSIVE VIBRATION CANCELLATION SYSTEM FOR MICROPHONE ASSEMBLY

BACKGROUND

The microphones of external portions of auditory prostheses are both highly sensitive and very fragile. As such, the microphones require protection from external elements that take the form of dirt, dust, sweat, water, and other substances that can be present in a given environment. A semi-water permeable filter can be utilized that provides a degree of resistance to substance ingress while allowing for the passage of air to a sound inlet of the microphone. However, such a solution is not able to withstand vigorous aquatic activities or other events such as significant rain, bathing, swirling dust, etc. Under such extreme circumstances, substances can be able to penetrate the -filter and can permanently degrade or destroy the microphone, rendering the device ineffective. Covering the microphone with a waterproof membrane can aid waterproofing, but the waterproof cover can increase vibrational noise.

SUMMARY

Embodiments disclosed herein relate to devices that are used to provide a passive vibration cancellation system for a microphone or other sound-receiving component of an auditory prosthesis that in certain embodiments, is also waterproof. The sound-receiving components include, but are not limited to, microphones, transducers, MEMS microphones, electret microphones, and so on. Example auditory prostheses include, for example, cochlear implants, hearing aids, bone conduction devices, or other types of devices. An assembly manufactured of a plurality of waterproof diaphragms and a more rigid support structure is sized to cover the sound-receiving component such as a microphone. The assembly includes multiple flexible diaphragms that deform in opposite directions when acted upon by sound, but deform in the same direction when acted upon by vibrations. The assembly can include a collar or other compliant element to help secure the assembly into the auditory prosthesis housing, while further reducing vibration transmission between the housing and the microphone.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

The technologies disclosed herein can be used in conjunction with various types of auditory prostheses, including active transcutaneous bone conduction devices, passive transcutaneous bone conducting devices, middle ear devices, cochlear implants, and acoustic hearing aids. In general, any type of auditory prosthesis that utilizes a microphone, transducer, or other sound-receiving component can benefit from the technologies described herein. The technologies described are particularly useful for head-mounted devices that include microphones, such as so-called button sound processors. Such head-mounted devices may be utilized in conjunction with cochlear implants, bone conduction devices, and other types of auditory prostheses. Additionally, the technology may be utilized in devices that are worn behind the ear of a recipient. Such devices are called behind-the-ear (BTE) sound processors. Additionally, the technologies can be incorporated into other devices that receive sound and send a corresponding stimulus to a recipient. The corresponding stimulus can be in the form of electrical signals, mechanical vibrations, or acoustic sounds. Additionally, the technology can be used in conjunction with other components of an auditory prosthesis. For example, the technologies can be utilized with sound processing components, speakers, or other components that can benefit from protection from water or debris, or from vibration isolation. For clarity, however, the technologies disclosed herein will be generally described in the context of microphones used in auditory prostheses that utilize a BTE device, such as those used in conjunction with a cochlear implant.

Figure 1:
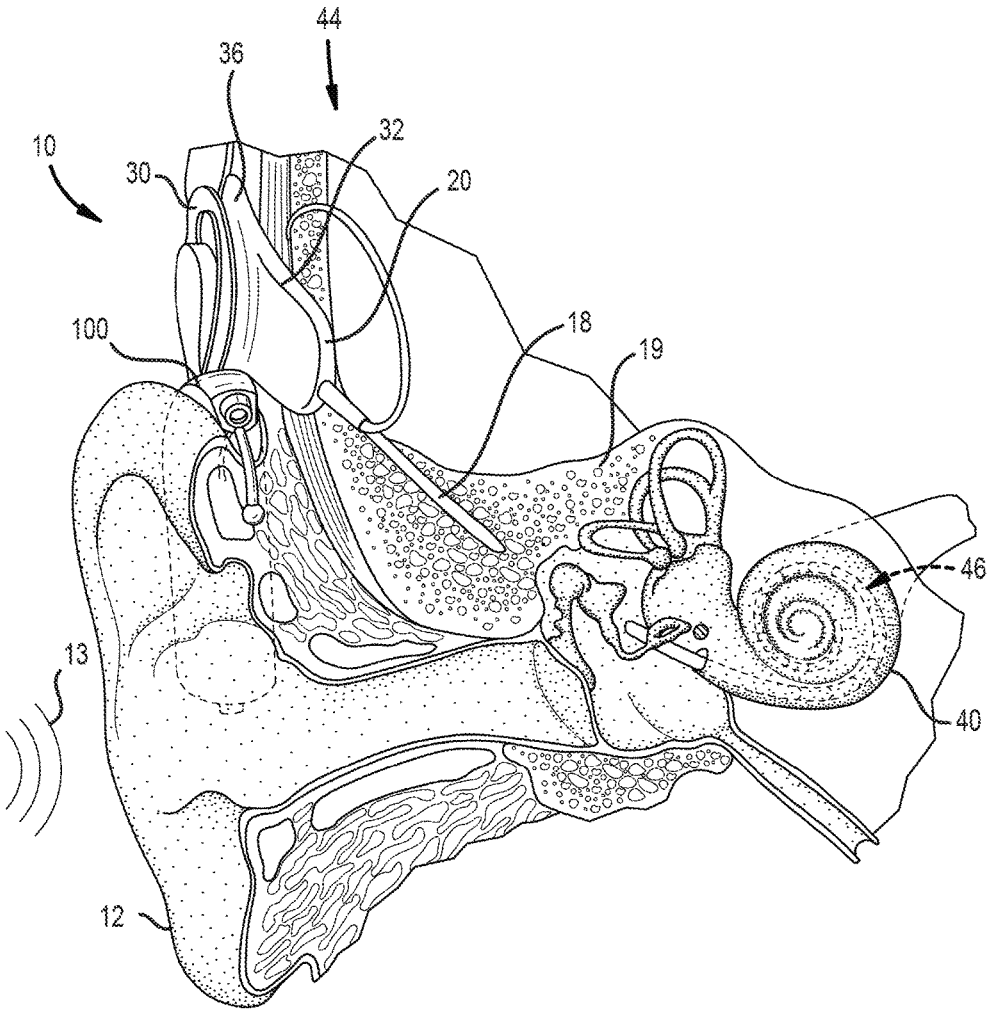
FIG. 1 is a partial view of a behind-the-ear auditory prosthesis worn on a recipient.

Referring to FIG. 1, cochlear implant system 10 includes an implantable component 44 typically having an internal receiver/transceiver unit 32, a stimulator unit 20, and an elongate lead 18. The internal receiver/transceiver unit 32 permits the cochlear implant system 10 to receive and/or transmit signals to an external device 100 and includes an internal coil 36, and preferably, a magnet (not shown) fixed relative to the internal coil 36. These signals generally correspond to external sound 13. Internal receiver unit 32 and stimulator unit 20 are hermetically sealed within a biocompatible housing, sometimes collectively referred to as a stimulator/receiver unit. The magnets facilitate the operational alignment of the external and internal coils, enabling internal coil 36 to receive power and stimulation data from external coil 30. The external coil 30 is contained within an external portion 50 such as the type depicted in FIG. 1A. Elongate lead 18 has a proximal end connected to stimulator unit 20, and a distal end implanted in cochlea 40. Elongate lead 18 extends from stimulator unit 20 to cochlea 40 through mastoid bone 19.

In certain examples, external coil 30 transmits electrical signals (e.g., power and stimulation data) to internal coil 36 via a radio frequency (RF) link, as noted above. Internal coil 36 is typically a wire antenna coil comprised of multiple turns of electrically insulated single-strand or multi-strand platinum or gold wire. The electrical insulation of internal coil 36 is provided by a flexible silicone molding. Various types of energy transfer, such as infrared (IR), electromagnetic, capacitive and inductive transfer, can be used to transfer the power and/or data from external device to cochlear implant.

There are a variety of types of intra-cochlear stimulating assemblies including short, straight and peri-modiolar. Stimulating assembly 46 is configured to adopt a curved configuration during and or after implantation into the recipient's cochlea 40. To achieve this, in certain arrangements, stimulating assembly 46 is pre-curved to the same general curvature of a cochlea 40. Such examples of stimulating assembly 46, are typically held straight by, for example, a stiffening stylet (not shown) or sheath which is removed during implantation, or alternatively varying material combinations or the use of shape memory materials, so that the stimulating assembly can adopt its curved configuration when in the cochlea 40. Other methods of implantation, as well as other stimulating assemblies which adopt a curved configuration, can be used.

Stimulating assembly can be a perimodiolar, a straight, or a mid-scala assembly. Alternatively, the stimulating assembly can be a short electrode implanted into at least in basal region. The stimulating assembly can extend towards apical end of cochlea, referred to as cochlea apex. In certain circumstances, the stimulating assembly can be inserted into cochlea via a cochleostomy. In other circumstances, a cochleostomy can be formed through round window, oval window, the promontory, or through an apical turn of cochlea.

Figure 1A:
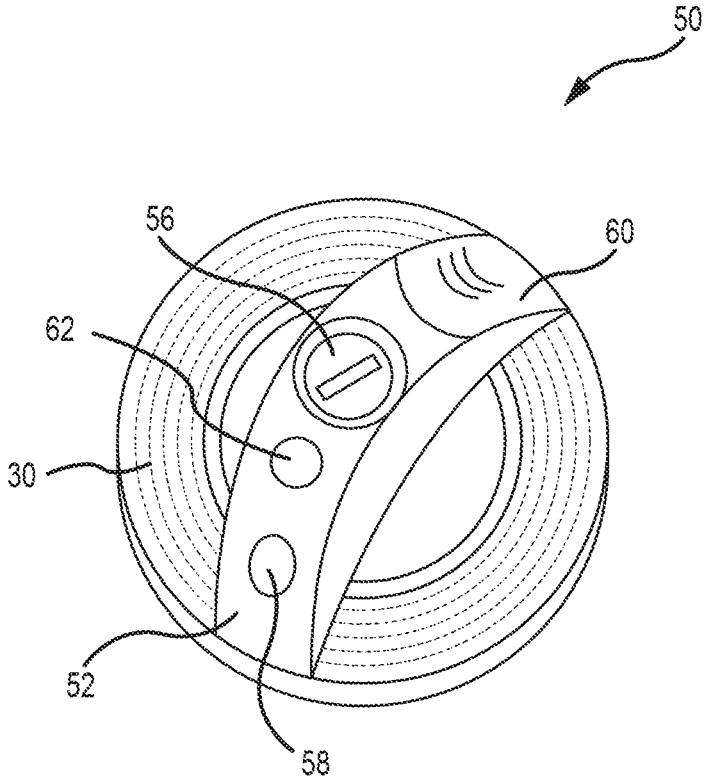
FIG. 1A is a side perspective view of an external portion of the auditory prosthesis of FIG. 1.

FIG. 1A is a perspective view of an embodiment of an external portion 50 of an auditory prosthesis, in this case, a button sound processor. The external portion 50 includes a body 52 and the external coil 30 connected thereto. The function of the external coil 30 is described above with regard to FIG. 1. The body 52 can include a permanent magnet 56 as described above, which helps secure the external portion 50 to the recipient's skull. The external portion 50 can include an indicator 58 such as a light emitting diode (LED). A battery door 60 covers a receptacle that includes a battery that provides internal power to the various components of the external portion 50 and the implantable portion. An opening 62 allows sound to travel into the body 52 to a microphone or other sound-receiving element disposed therein. The sound is processed by components within the external portion 50.

Figure 1B:
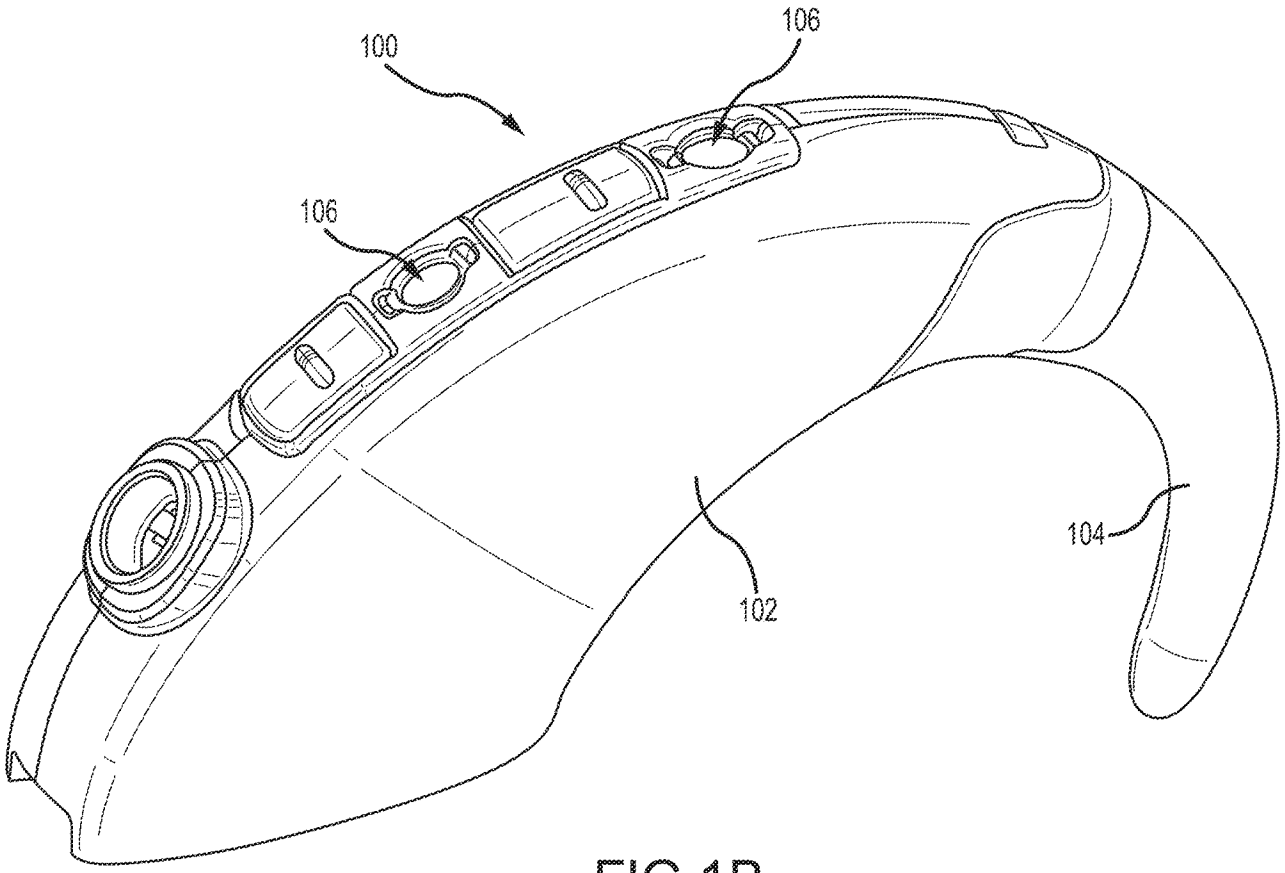
FIG. 1B is a side perspective view of another external portion of the auditory prosthesis of FIG. 1.

FIG. 1B depicts another embodiment of an external portion 100 of an auditory prosthesis, in this case, a BTE sound processor. The external portion 100 includes a housing 102 and an ear hook 104 extending therefrom to help secure the external portion 100 to the ear of a recipient. More specifically, the ear hook 104 wraps around the upper portion of an ear of the recipient. The housing 102 of the external portion 100 defines one or more openings 106 that allow sound to travel into the housing 102, to a microphone or other sound-receiving element disposed therein. These openings 106 form a penetration in the housing 102 that can allow water, dirt, or other debris to enter the housing 102. Such ingress can damage the microphone and/or other elements within the housing 102. In the depicted embodiment, the openings 106 are depicted as round in shape, but openings having other shapes are contemplated. The technologies described herein are described in the context of microphones utilized in the external portion 100 that is worn on the ear of a recipient. However, since the external portion 50 described above also includes a microphone, the technologies described herein are equally applicable to microphones utilized in such external portions that attach to a recipient's skull.

Figure 2A:
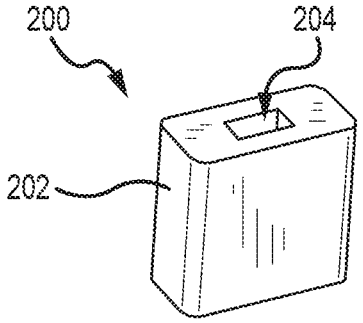
FIGS. 2A-2F depict partial views of a microphone assembly for an auditory prosthesis.
Figure 2B:
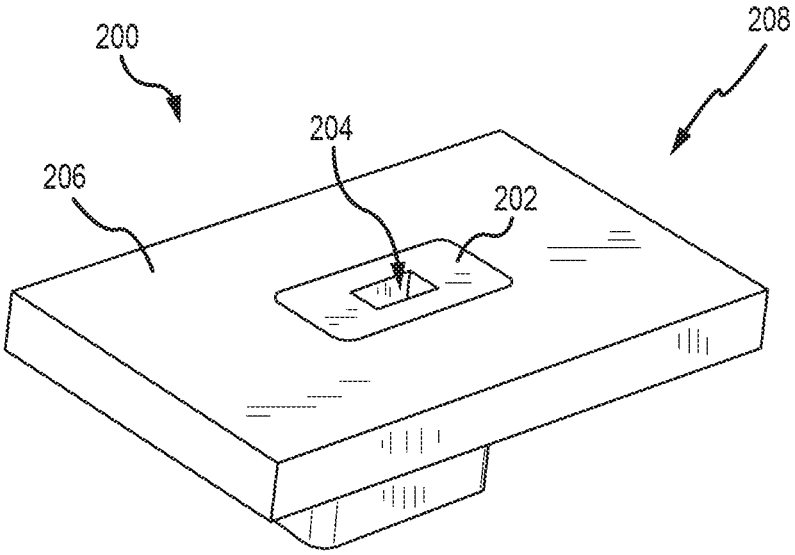
Figure 2C:
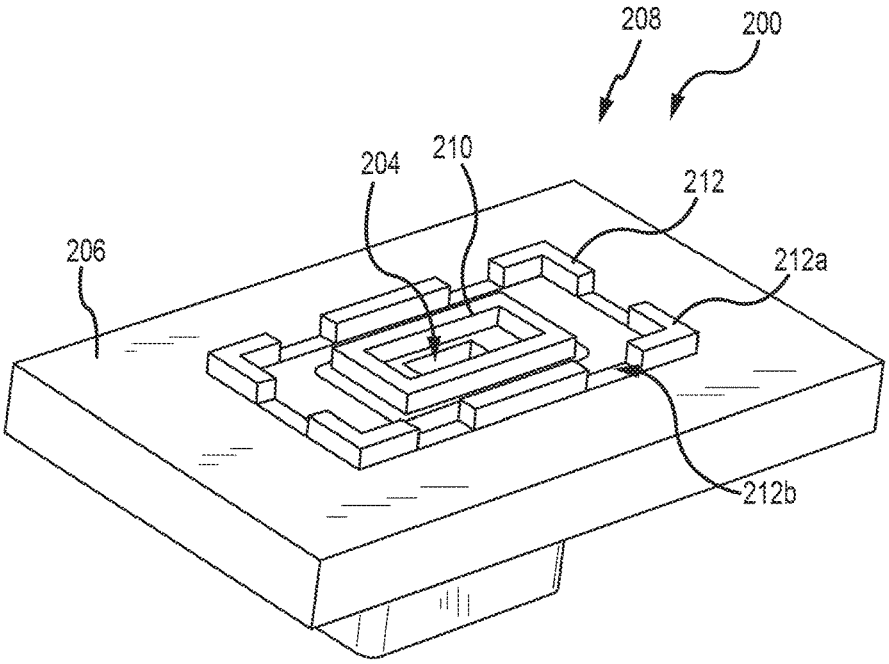
Figure 2D:
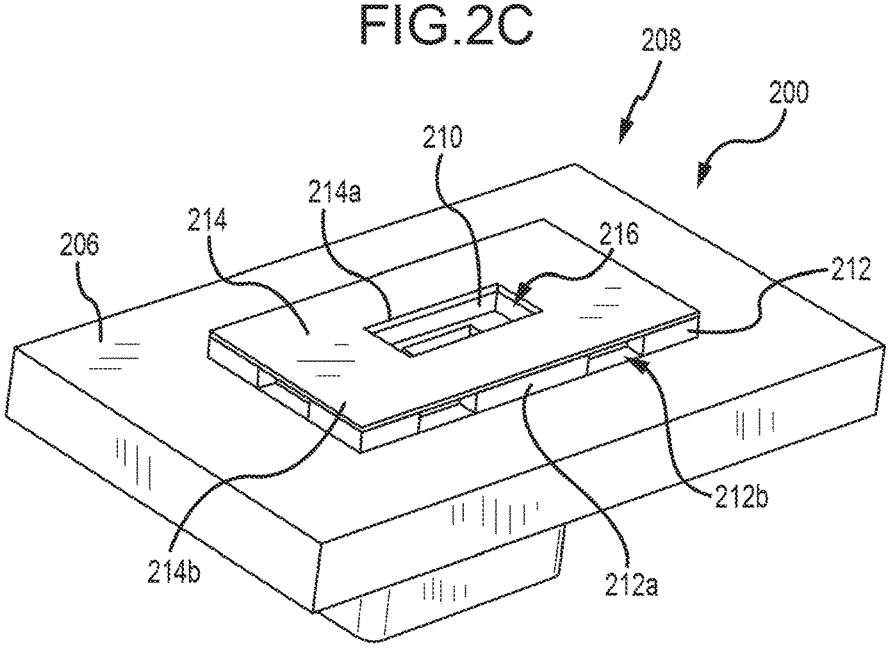

FIGS. 2A-2F depict partial views of a microphone assembly 200 for an auditory prosthesis, and are described together. The microphone assembly 200 includes a microphone 202 having a sound inlet 204. The microphone 202 is supported by a portion of a housing of the auditory prosthesis, which also acts as a base 206 for a passive vibration cancellation system 208. In other embodiments, the base 206 can be a structure discrete from the housing, or can be an internal portion of the housing, such that the passive vibration cancellation system is disposed and protected within the housing of the auditory prosthesis. The passive vibration cancellation system 208 (portions thereof are depicted in FIGS. 2C-2F) is disposed above the sound inlet 204. The passive vibration cancellation system 208 includes a frame having a lower support structure including a lower inner frame 210 and a lower outer frame 212. In the depicted embodiment, the lower inner frame 210 is a substantially contiguous wall surrounding the sound inlet 204. The lower inner frame 210 forms a portion of a waterproof enclosure about the sound inlet 204. The lower outer frame 212 includes a plurality of walls 212*a* separated by a number of openings 212*b*. A first or lower diaphragm 214 is supported by the lower support structure. More specifically, the lower diaphragm 214 includes an inner edge 214*a* and an outer edge 214*b*. The inner edge 214*a* is supported by the lower inner frame 210 and defines an opening 216. As depicted in FIG. 2D, the opening 216 is substantially aligned with the sound inlet 204 of the microphone 202. The outer edge 214*b* is supported by the lower outer frame 212.

Figure 2E:
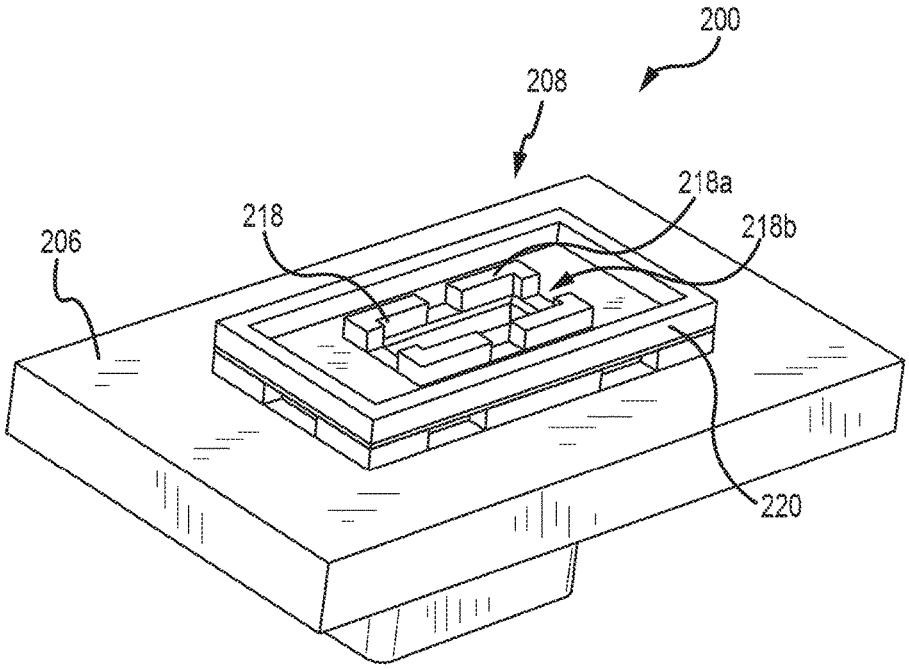
Figure 2F:
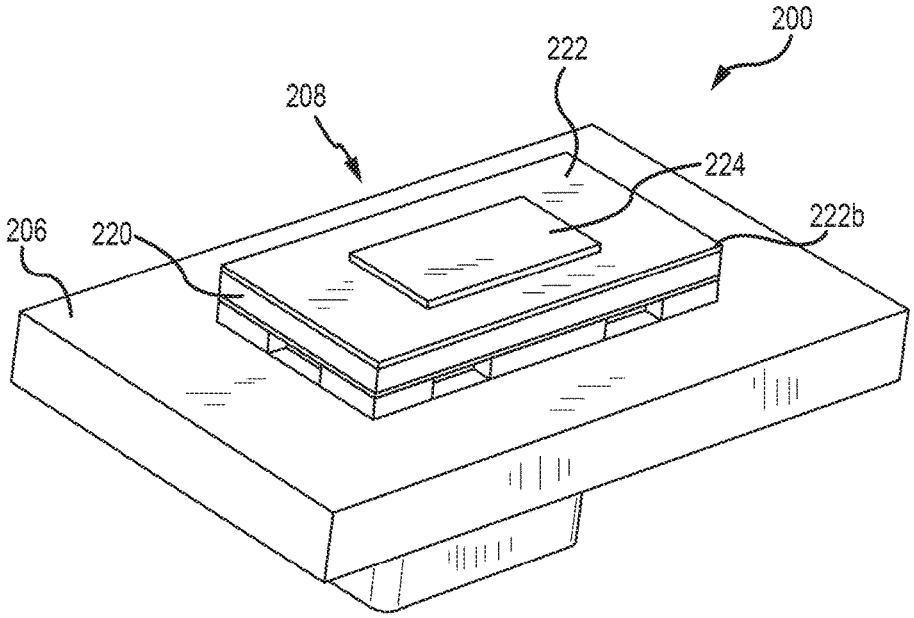

FIG. 2E depicts further detail of the passive vibration cancellation system 208, namely, an upper support structure of the frame. The upper support structure includes an upper inner frame 218 and an upper outer frame 220. In the depicted embodiment, the upper outer frame 220 is a substantially contiguous wall. The upper outer frame 220 forms a portion of the waterproof enclosure about the sound inlet 204. The upper inner frame 218 includes a plurality of walls 218*a* separated by a number of openings 218*b*. A second or upper diaphragm 222 is supported by the upper support structure and is substantially parallel to the lower diaphragm 214. More specifically, the upper diaphragm 222 can include an inner edge (which would be hidden by a rigid plate 224 in FIG. 2F) and an outer edge 222*b*. The inner edge, if present, is supported by the upper inner frame 218 and, in certain embodiments, defines an opening (generally located below the rigid plate 224). In other embodiments, no opening is present in the upper diaphragm 222, but a portion of the upper diaphragm 222 proximate the upper inner frame 218 is nevertheless supported by the upper inner frame 218. The opening in the upper diaphragm 222 (if present) is substantially aligned with the sound inlet 204 of the microphone 202, as well as the opening 216 in the lower diaphragm 214. The outer edge 222*b* is supported by the upper outer frame 220. The rigid plate 224 is substantially aligned with the sound inlet 204 of the microphone 202, the opening 216 in the lower diaphragm 214, and the opening of the upper diaphragm 222 (if present). FIG. 2F depicts the complete passive vibration cancellation system 208.

Figure 3:
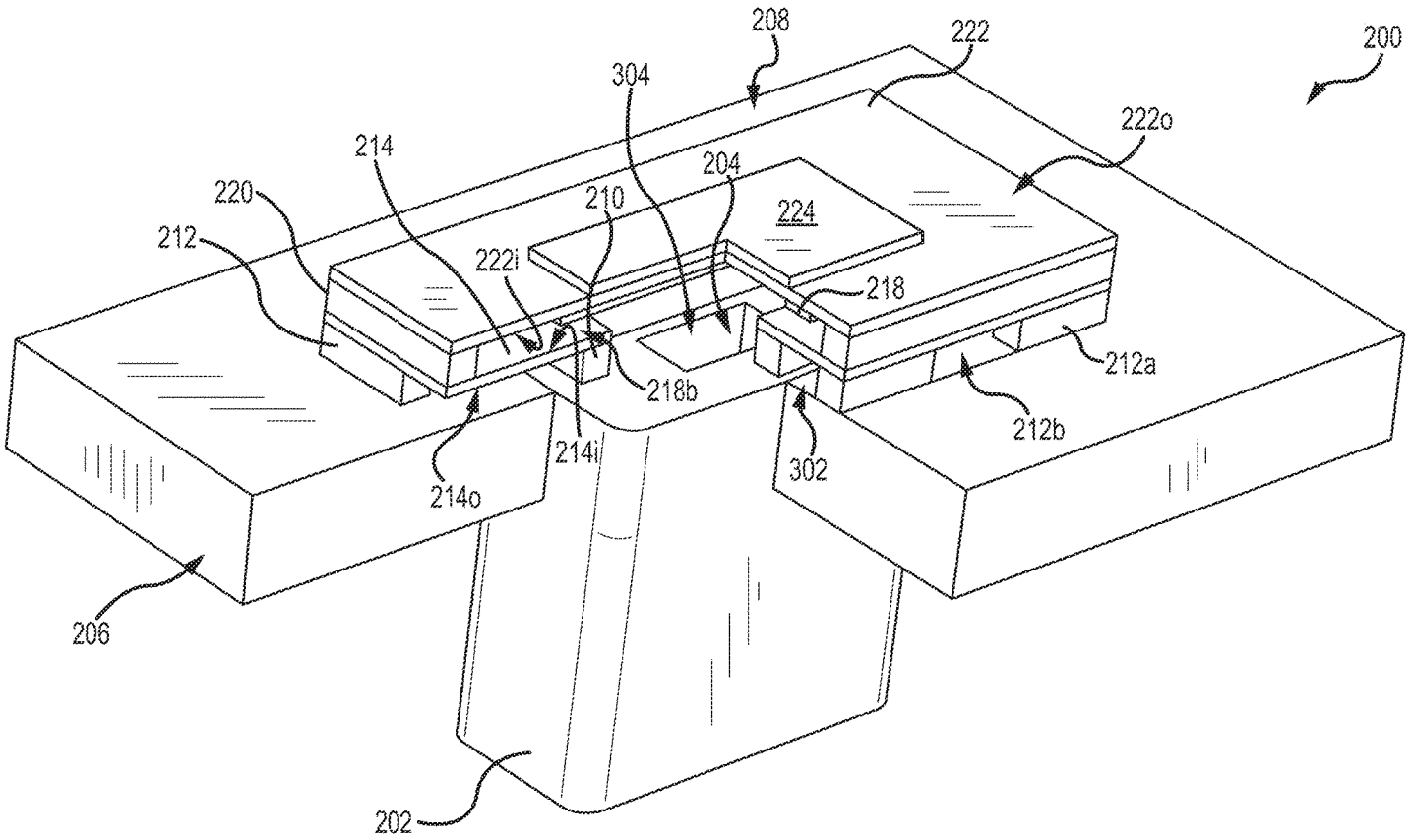
FIG. 3 is a partial cut-away perspective view of the microphone assembly of FIG. 2F.

FIG. 3 is a partial cut-away perspective view of the microphone assembly 200 of FIG. 2F, including the passive vibration cancellation system 208. As can be seen in this view, the upper diaphragm 222 does not include an opening disposed below the rigid plate 224. The passive vibration cancellation system 208 depicted in FIG. 3 at least partially defines at least two discrete volumes. The first volume is an open volume 302 defined by the base 206, the lower outer frame 212, the lower inner frame 210, and the lower diaphragm 214. Due to the presence of the openings 212*b* in the lower outer frame 212, the open volume 302 is exposed to and in communication with ambient air outside of the housing. Thus, sound input (e.g., speech) directed at the auditory prosthesis will be able to contact an outer surface 214*o* of the lower diaphragm 214. The effect of this contact is described in more detail herein. The second volume is a closed cavity volume 304 defined by the lower inner frame 210, the lower diaphragm 214, the upper outer frame 220, the upper diaphragm 222, and the rigid plate 224 (if an opening is present in the upper diaphragm 222). The closed cavity volume 304 is a closed volume that is in communication with and covers the sound inlet 204 of the microphone 202. Each of the lower diaphragm 214 and upper diaphragm 222 include inner surfaces 214*i*, 222*i*, respectively, that face each other in the closed cavity volume 304. The upper diaphragm 222 also includes an outer surface 222*o* that is exposed to ambient air outside the housing. Thus, sound input (e.g., speech) directed at the auditory prosthesis will be able to contact the outer surface 222*o* of the upper diaphragm 222. Both diaphragms 214, 222 can be made of a moisture-resistant and compliant material, e.g., silicone. The various frames of the support structure are made of a more rigid material such as hard plastic or metal. The interface between the various parts (membranes 214, 222; supports/frames 210, 212, 218, 220; microphone 202; and base 206) can be made watertight by appropriate sealing (e.g., adhesive, thermal, or ultrasonic bonding). Consequently, the closed cavity volume 302 prevents moisture or fluid ingress from outside to the sound inlet 204 of the microphone 202. The outer surfaces 214*o*, 222*o* of the two diaphragms 214, 222 can be coated with or made from a hydrophobic material to help repel water or sweat that can come into contact with the surfaces 214*o*, 222*o*, due to their exposure to ambient air.

Figure 4A:
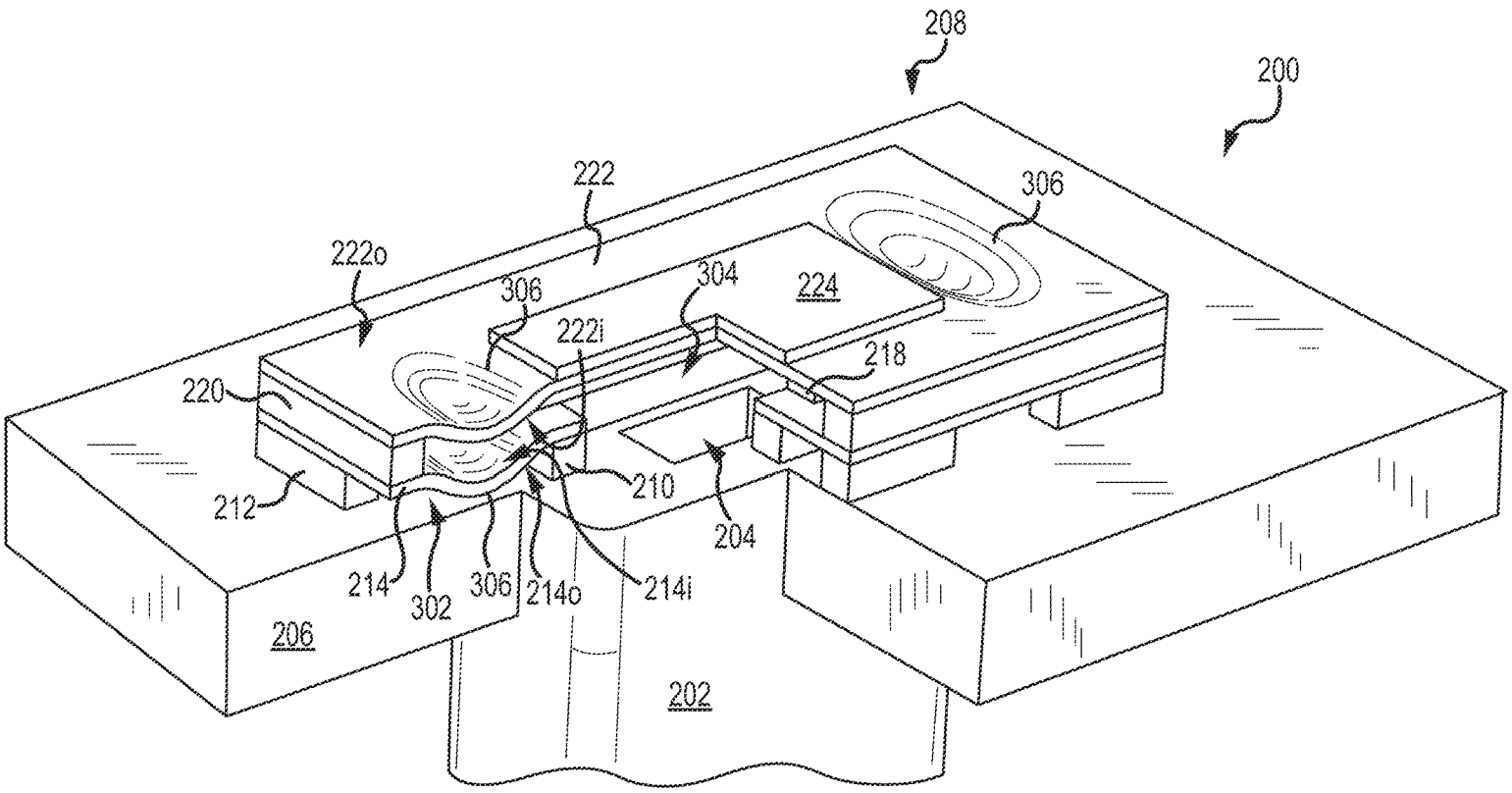
FIG. 4A is a partial cut-away perspective view of a microphone assembly deflecting due to vibration input.

FIG. 4A is a partial cut-away perspective view of a microphone assembly 200 deflecting due to vertical vibration input. Both the lower diaphragm 214 and the upper diaphragm 222 have substantially equal free areas. The free area of each diaphragm, in one embodiment, can be defined as the portion of each membrane 214, 222 configured to deflect or move when subjected to a vibration or acoustic input. That is, the free area is the portion of each diaphragm 214, 222 not bonded or adhered to the various frames of the support structure. The rigid plate 224 prevents deflection of a portion of the upper diaphragm 222. Thus, the free areas of the lower diaphragm 214 and upper diaphragm 222, in this embodiment, are those areas supported and bounded by the lower and upper, outer and inner frames 212, 220, 210, 218. Both membranes 214, 222 are configured so as to cancel each other out with respect to the closed cavity volume 302 change due to a vibration input, as depicted in FIG. 4A. The vibration input is depicted as vibration deflections 306. Notably, the vibration deflections 306 are in substantially the same single direction, where the upper diaphragm 222 deflects into the closed cavity volume 304 and lower diaphragm 214 deflects into the open volume 302. Of course, the diaphragms 214, 222 can deflect in the opposite direction, depending on the vibrational force. However, it should be noted that both diaphragms 214, 222 deflect on a single (e.g., the same) direction when subjected to a vibration input. The deflection 306 of each associated diaphragm defines a volume change ΔV of the closed cavity volume 304. The relationship between the volume changes ΔV defined by each vibration deflection 306 in the associated diaphragms is quantified in Equation I:

$$\Delta V_{LowerDiaphragm}^{Vibration} - \Delta V_{UpperDiaphragm}^{Vibration} \approx 0$$

When this condition is fulfilled, there is substantially no net volume change of the closed cavity volume 304. The resulting closed cavity volume 304 pressure change will be negligible, and thus the vibration-induced microphone output is small (e.g., close to the inherent vibration sensitivity of the microphone transducer itself). In one embodiment, the diaphragms 214, 222 are of the same material, same thickness, and same free area. In the embodiment of FIG. 4A, the rigid plate 224 helps define the free area of the upper diaphragm 222. Otherwise, the upper diaphragm 222 would have a larger free area than the lower diaphragm 214, and thus induce a larger closed cavity volume change than is compensated for by the lower diaphragm 214. The resulting net closed cavity volume 304 change causes an increase of the vibration sensitivity of the passive vibration cancellation system 208.

Figure 4B:
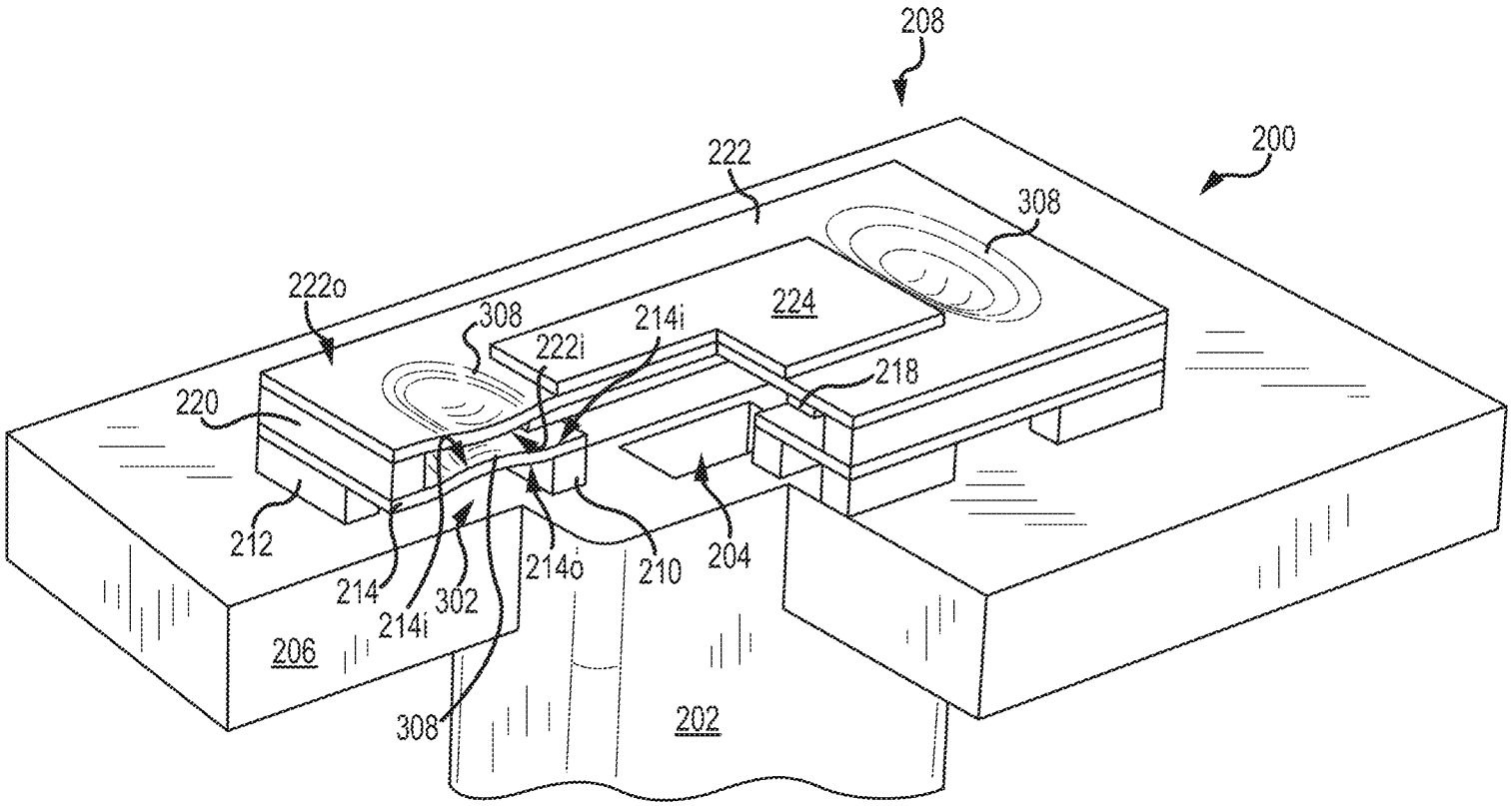
FIG. 4B is a partial cut-away perspective view of a microphone assembly deflecting due to acoustic input.

FIG. 4B is a partial cut-away perspective view of a microphone assembly 200 deflecting due to acoustic input. The various components of the passive vibration cancellation system 208 are generally described above. Contrary to the vibration input of FIG. 4A, where both vibration deflections 306 cancel each other out, because deflection of both diaphragms 214, 222 is in the same (single) direction, acoustic deflections 308 due to acoustic input complement each other. This is beneficial to achieve a high acoustic sensitivity as the net volume change of the closed cavity volume 304 results in a pressure change that is sensed by the microphone. The relationship between the volume changes ΔV of the closed cavity volume 304 defined by each acoustic deflection 308 in the associated diaphragms is quantified in Equation II:

$$\Delta V_{LowerDiaphragm}^{Acoustic} \approx \Delta V_{UpperDiaphragm}^{Acoustic}$$

In other embodiments, acoustic sensitivity can be increased by omitting the rigid plate 224, although this would reduce or nullify the conditions for a low vibration sensitivity (per Equation I) as the net volume displacement would no longer be negligible, per Equation III:

$$|\Delta V_{LowerDiaphragm}^{Vibration}| < |\Delta V_{UpperDiaphragm}^{Vibration}|$$

EXAMPLE 1

Figure 5A:
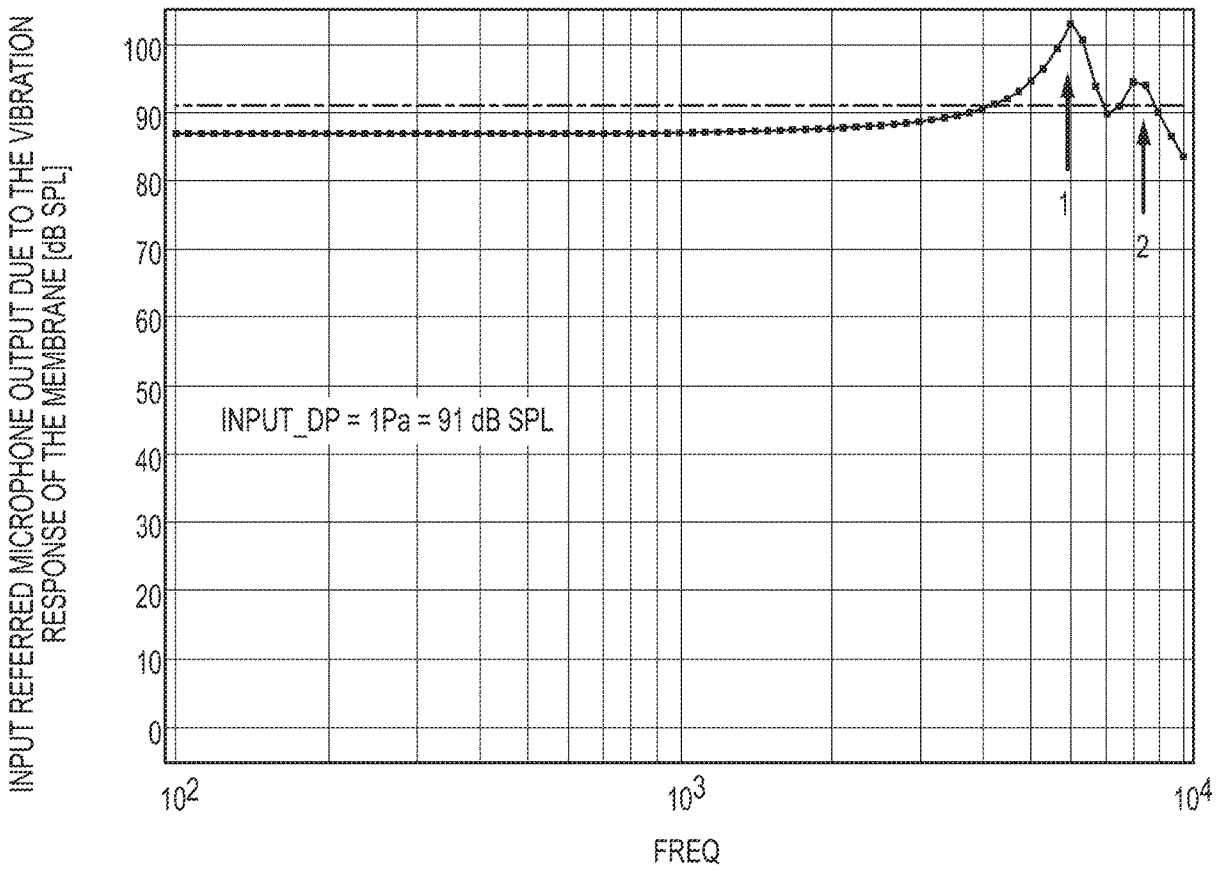
FIGS. 5A and 5B depict plots of acoustic sensitivity and vibration sensitivity, respectively, of a model microphone assembly utilizing a passive vibration cancellation system.

FIG. 5A depicts the results of a modeled acoustic attenuation test for a microphone assembly that utilizes a passive vibration cancellation system such as that depicted in the above FIG. 3. When utilizing thin, compliant diaphragms, acoustic attenuation does not exceed 3 dB SPL. Thus, the effect on acoustic performance for a dual diaphragm system, such as depicted herein, is minimal.

Initial simulations were performed to show the advantageousness of a dual-diaphragm passive vibration cancellation system, as described herein. A computational model was prepared as follows. A microphone with dimensions that are conventional for auditory prosthesis applications was considered: L×W×H=3.6 mm×1.7 mm×3.6 mm. Both upper and lower diaphragms had dimensions of 6 mm×3 mm×0.1 mm, a density of 1280 kg/m$^3$ and a Young's modulus of 4.2 MPa. In application, the diaphragms could be made from silicone. The harder portions of the system (e.g., support structure/frames, base, and rigid plate) had a much larger Young's modulus of 2.9 GPa and a density of 1760 kg/m$^3$. In application, such components could be manufactured from PVC. The distance between both diaphragms was defined as 0.3 mm. It was noted that too large of a distance would reduce the acoustic sensitivity, since a larger closed cavity volume 304 lowers the internal pressure variations (as per the ideal gas law for an adiabatic process, expressed in Equation IV):

$$\left(\frac{P}{P_0}\right)\left(\frac{V}{V_0}\right)^{\gamma} = 1$$

The acoustic sensitivity for an input level of 1 Pa is plotted in FIG. 5A. The dashed line represents the applied sound input level. The acoustic attenuation by the membranes is about 3 dB SPL. It was noted that this result is similar to measured attenuation for a microphone with a single silicone diaphragm covering the sound inlet (testing related thereto is not described further herein). At high frequencies (e.g., greater than about 4 kHz) the acoustic sensitivity peaks at the resonance frequencies (points 1 and 2 on FIG. 5A) are mainly governed by the membrane properties (e.g., dimensions and mechanical material properties). In order not to jeopardize the sound quality within the speech frequency range (e.g., about 0.4 kHz up to about 4 kHz), it is a good practice to choose the membrane properties such that the membrane resonance frequencies exceed 4 kHz.

Figure 5B:
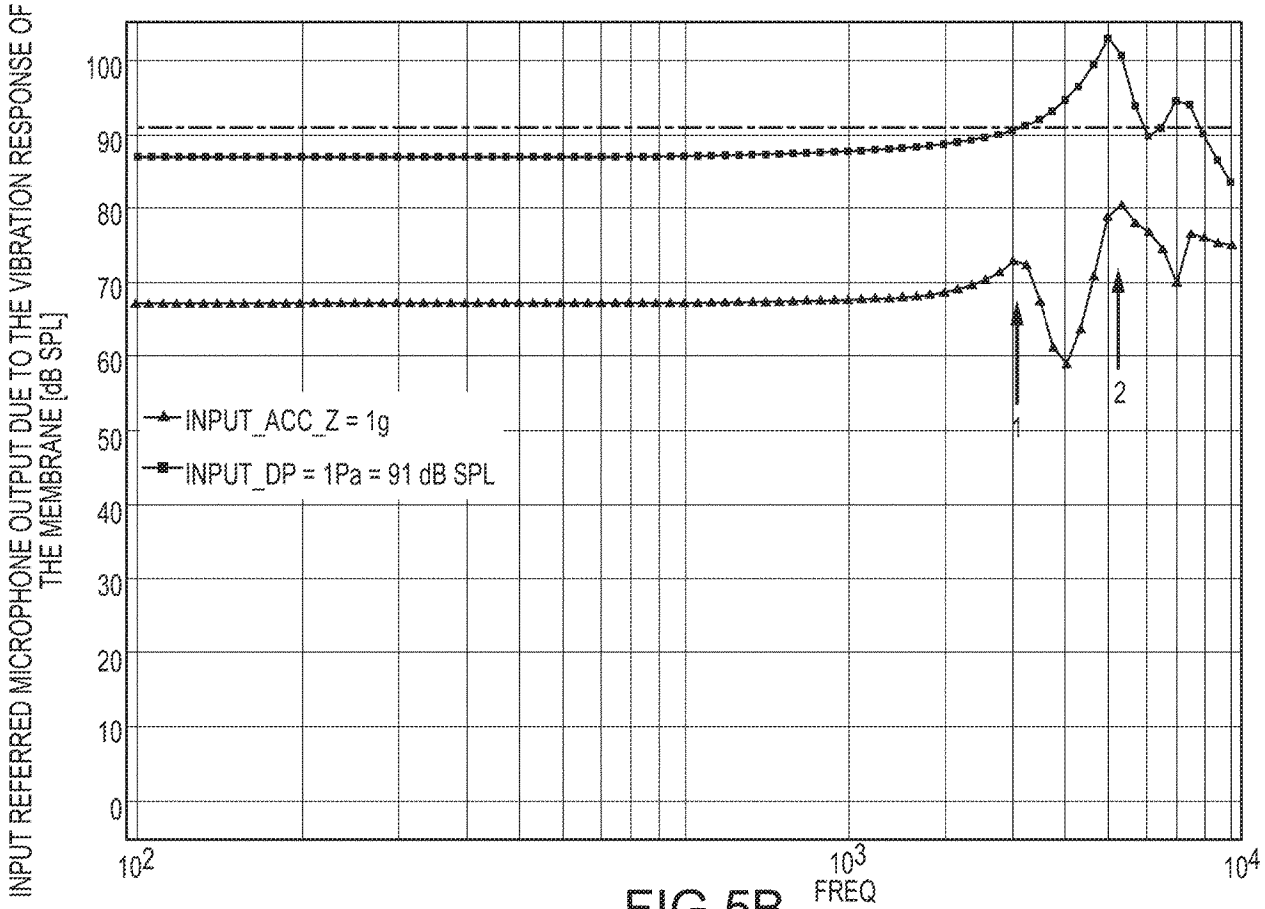

Vibration sensitivity for an input acceleration level of 1 g is plotted in FIG. 5B (the plot of FIG. 5A is also depicted for comparison). Here, the vibrations are orthogonal to the membrane surface, which is a worst-case scenario since that direction causes the largest membrane deflections. In FIG. 5B, the advantage of a low vibration sensitivity of the passive vibration cancellation system is clearly visible. At the input acceleration level of 1 g, the microphone response is about 20 dB SPL lower than the microphone response at an acoustic input level of 1 Pa. Similar to the acoustic sensitivity of FIG. 5A, the vibration sensitivity shows high frequency resonance peaks (points 1 and 2 on FIG. 5B), again mainly governed by the membrane properties (dimensions and mechanical material properties).

The results depicted in FIGS. 5A and 5B represent a significant improvement with respect to existing solutions that utilize a single diaphragm to make a microphone assembly waterproof. For example, the vibration sensitivity for a microphone with a single diaphragm silicone cover has been calculated to be about 90 dB SPL, thus more than 20 dB SPL above the vibration sensitivity for a microphone with the dual diaphragm passive vibration cancellation system disclosed herein. This means that for a microphone with single silicone diaphragm, a vibration at the level of 1 g will sound almost as loud as an acoustic input of 1 Pa (e.g., about 90 dB SPL). In case of a microphone with the dual-diaphragm configuration, the same vibration level will generate a significantly lower vibration noise (e.g., about 70 dB SPL).

Figure 6:
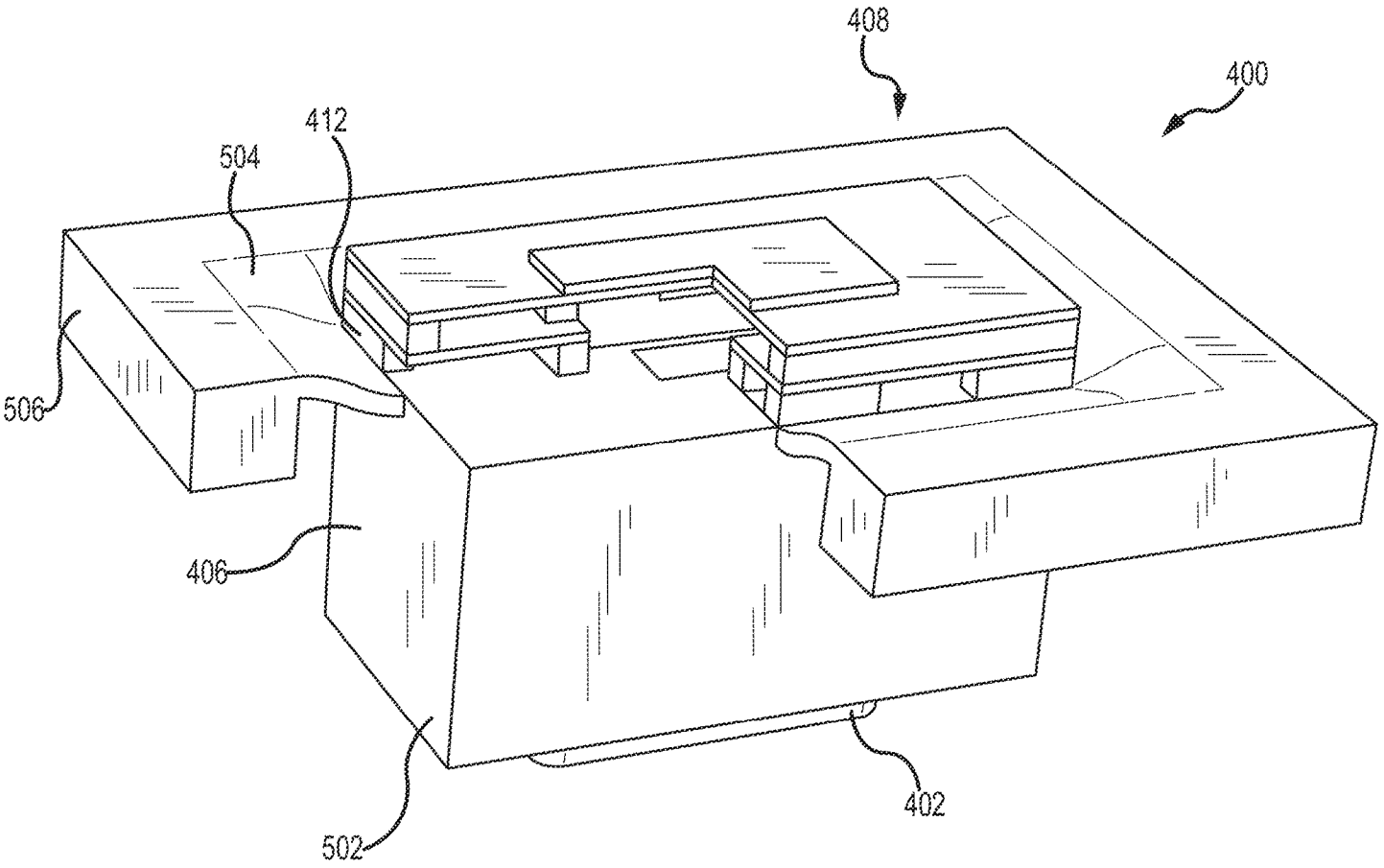
FIG. 6 is a partial cut-away perspective view of a microphone assembly utilizing a suspension system.

Moving on from Example 1, FIG. 6 is a partial cut-away perspective view of a microphone assembly 400 utilizing a suspension system. The components of the microphone assembly 400 are depicted above in other embodiments and are thus generally not described further. The microphone assembly 400 includes a microphone 402 and a passive vibration cancellation system 408. A base 406 of the passive vibration cancellation system 408, in this embodiment, corresponds to a portion of a mass 502 that substantially surrounds the microphone 402. A compliant collar 504 connects the base 406 to a portion of a structure 506 of an auditory prosthesis, but in other embodiments, the collar can be connected directly to the frame itself (e.g., the lower outer frame 412). By utilizing the collar 504, the vibration noise at high frequencies can be further reduced. The frequency above which the collar 504 becomes effective is referred to as cutoff frequency $f_C$ (Hz) and is depicted in Equation V:

$$f_c = \sqrt{\frac{k}{m}}$$

where k=stiffness of the compliant component (N/m), and m=suspended mass (kg).

Figure 7:
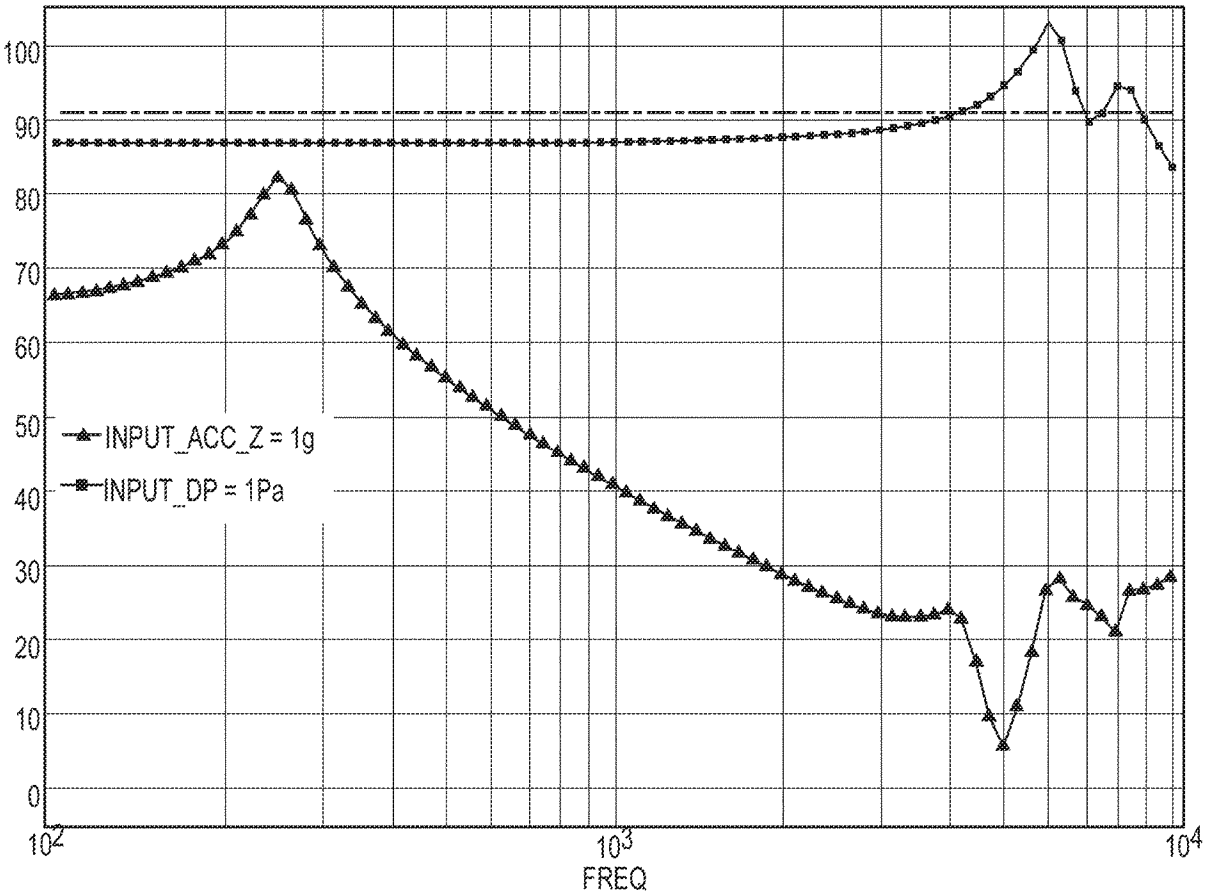
FIG. 7 depicts a plot of vibration sensitivity of a microphone assembly utilizing a suspended passive vibration cancellation system.

It can be advantageous to have a low cutoff frequency in order to make the vibration isolation as efficient as possible. This can be achieved, in certain embodiments, by utilizing a large suspended mass 502 (which adds extra weight to the microphone 402) and/or by designing the collar 504 to have a low spring stiffness k. In FIG. 6, for example, the passive vibration cancellation system 408 incorporates the compliant suspension collar 504 around the microphone assembly 400. Furthermore, the suspended mass of the assembly 400 is increased by the additional mass 502 around the microphone 402. The effect of the additional suspension collar 504 on the vibration noise level is depicted in FIG. 7. Beyond the suspension cutoff frequency, the vibration sensitivity is decreasing. At the low frequencies, the vibration sensitivity level is substantially unaltered. Around the cutoff frequency, due to resonance of the mass-collar system, there is an increased level of vibration sensitivity. In one embodiment, the use of a viscoelastic material with high loss factor for the collar 504 can dampen this resonance peak.

Figure 8A:
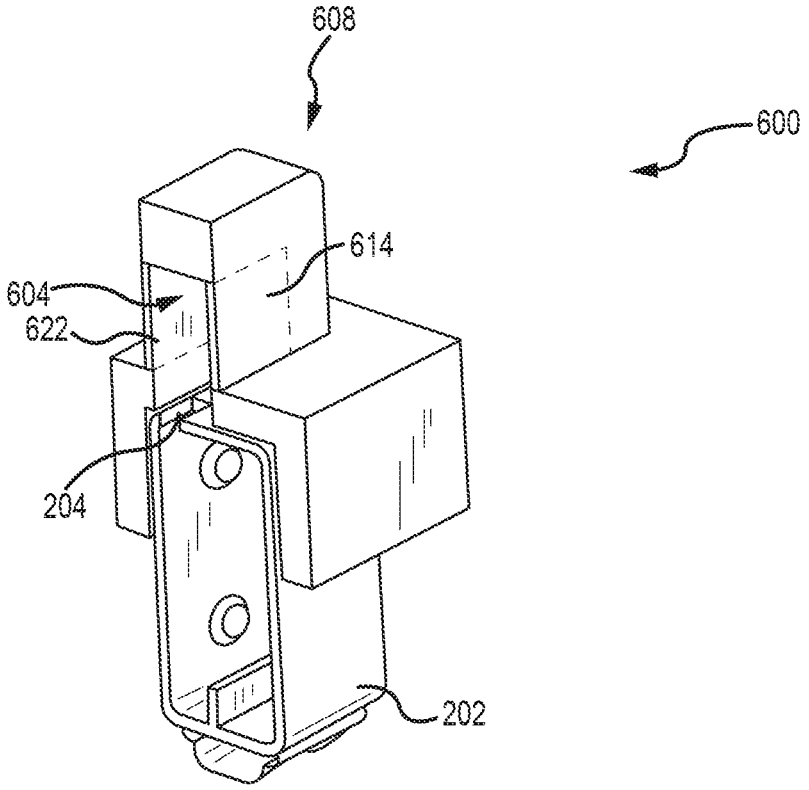
FIGS. 8A and 8B depict partial cut-away perspective views of other embodiments of microphone assemblies for auditory prostheses.
Figure 8B:
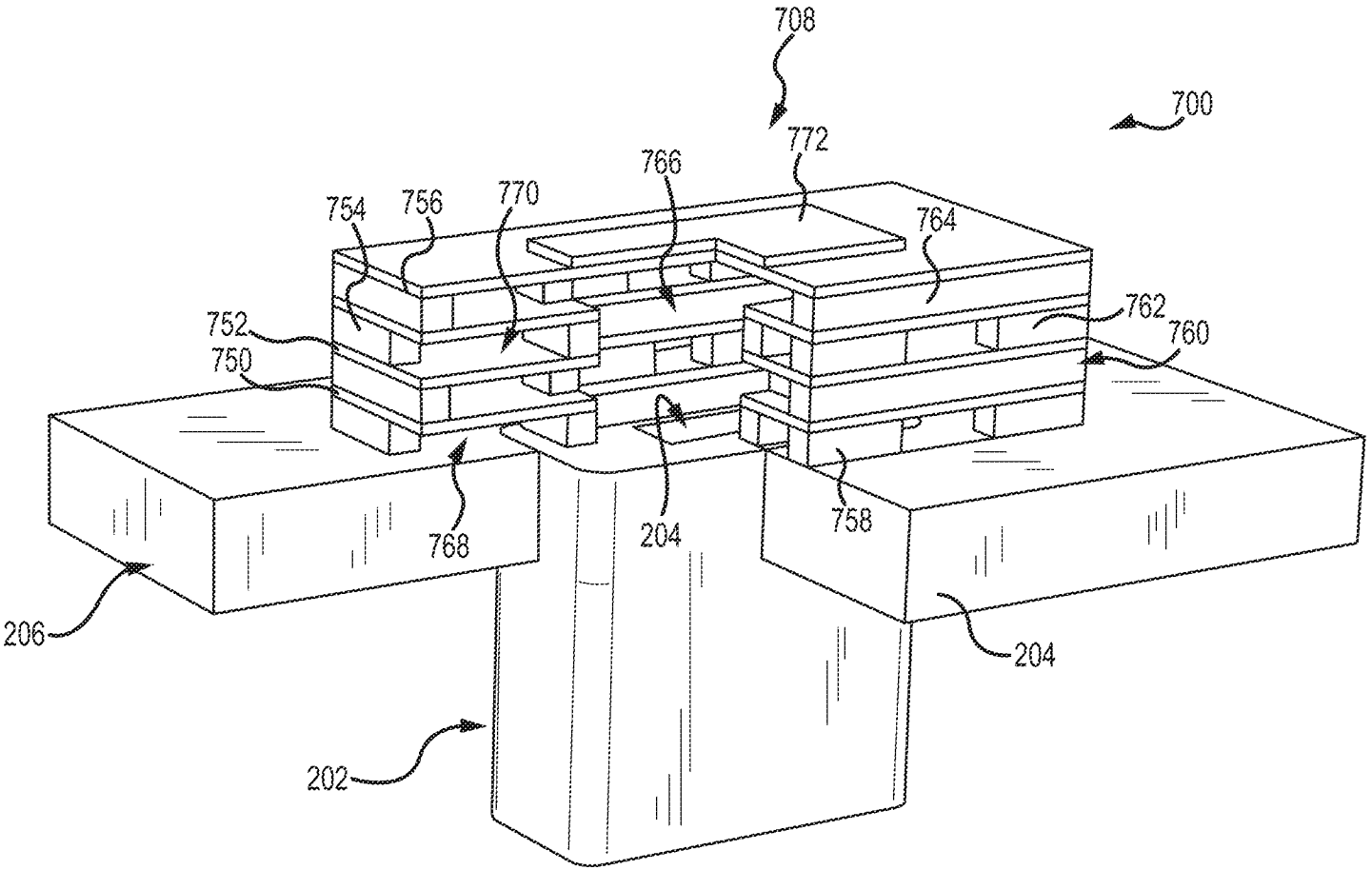

FIGS. 8A and 8B depict partial cut-away perspective views of other embodiments of microphone assemblies for auditory prostheses. FIG. 8A depicts a microphone assembly 600 having first and second vertically-oriented diaphragms 614, 622. Here, the support structure includes a single, closed outer frame 612. Thus, the first diaphragm 614, the frame 612, and the second diaphragm 622 define a closed cavity volume 604 in communication with a sound inlet 204 of a microphone 202. The microphone 202 is depicted as a hollow housing, but would include multiple electronic components. The diaphragms 614, 622 deflect under acoustic and vibration input as described herein.

FIG. 8B depicts an embodiment of a microphone assembly 700 having a passive vibration cancellation system 708. In this case, the passive vibration cancellation system 708 includes four diaphragms 750, 752, 754, 756, which are supported by a support structure including four frame portions 758, 760, 762, 764, each having inner and outer walls. The inner and outer walls of each frame portion 758, 760, 762, 764 are either solid, or define a plurality of openings, as depicted. Thus, a closed cavity volume 766 is formed in part by the facing inner surfaces of diaphragms 750, 752 and the facing inner surfaces of diaphragms 754, 756. Additionally, the outer walls of frame portions 760, 764, as well as the inner walls of frame portions 758, 762 completely close the closed cavity volume 766 that is in communication with the sound inlet 204 of the microphone 202. Additionally, the outer facing surfaces of diaphragm 750 and the base 206, as well as the outer facing surfaces of the diaphragms 752, 754 at least partially define open volumes 768, 770, that allow those surfaces to be subject to acoustic input. As described above, a rigid plate 772 covers at least a portion of the top diaphragm 756, thereby limiting the free area of that diaphragm 756. The benefits attendant with these matching diaphragms and the resultant deflections helps limit vibrational noise, as described above.

For clarity, the passive vibration cancellation systems depicted herein have generally rectangular diaphragms, but other shapes are contemplated, such as square, circular, elliptical, or irregular. The shape and size of the diaphragm free area (which is the pressure sensitive area) influences the acoustic sensitivity of the passive vibration cancellation system. The form factor of the diaphragms can be used to avoid the occurrence of resonance peaks, generally for frequencies below 10 kHz. It has been discovered that the use of multiple diaphragms is a desirable way to avoid resonances within the speech frequency range, while still ensuring acceptable acoustic sensitivity. The use of an asymmetric shape for the free area has the advantage that the resonance peaks will be less sharp.

The diaphragms described herein can be manufactured of silicone or other resilient material, such as rubbers, thermoplastic elastomers, etc. Materials that provide water resistance without adversely effecting sound attenuation are particularly desirable. The diaphragms can be coated with one or more films or coatings to improve performance or increase operable life. Hydrophobic coatings can be particularly desirable, as are coatings that increase UV light resistance to prevent degradation of the diaphragms. Known injection molding processes can be utilized in manufacture to obtain the required structures within appropriate tolerances.

The various embodiments of the passive vibration cancellation systems depicted herein are manufactured so as to further reduce attenuation of sound waves directed at the microphone, or reduce vibrations within the prosthesis housing. In one embodiment, the diaphragms can be manufactured so as to limit stretching thereof when the diaphragm is bonded to the frame. Stretching of the diaphragms can attenuate sound, lead to more rapid degradation of the diaphragm material, and make the exposed portions more susceptible to tearing. Thus, the diaphragms can be manufactured in close tolerance to the dimensions of the support structure to limit such stretching. In other embodiments, however, the diaphragms can stretch, although it can be desirable to limit the degree of stretching, for at least the reasons described above.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

a housing;

a microphone disposed in the housing; and a plurality of diaphragms, wherein:

the plurality of diaphragms and a sound inlet of the microphone at least partially define a closed cavity volume that is in communication with and covers the sound inlet such that ingress of unwanted fluid into the closed cavity volume and adjacent to the sound inlet of the microphone is prevented;

the plurality of diaphragms is arranged such that, when subjected to a vibration that causes vibration deflection of the plurality of diaphragms, a net volume change of the closed cavity volume as a result of the vibration deflection is negligible; and the plurality of diaphragms is arranged such that receipt of an acoustic input that causes acoustic deflection of the plurality of diaphragms results in a non-negligible net volume change of the closed cavity volume as a result.

2. The apparatus of claim 1, wherein the plurality of diaphragms is waterproof.

3. The apparatus of claim 1, wherein the plurality of diaphragms is arranged such that, when subjected to a vibration, the net volume change of the closed cavity volume corresponds with an inherent vibration sensitivity of the microphone.

4. The apparatus of claim 1, wherein each diaphragm of the plurality of diaphragms is constructed from a same material and has a same thickness.

5. The apparatus of claim 1, wherein each diaphragm of the plurality of diaphragms has a free area configured to deflect when subjected to a vibration or acoustic input.

6. The apparatus of claim 5, wherein each diaphragm of the plurality of diaphragms has a same free area size.

7. The apparatus of claim 6, further comprising a rigid plate covering at least a portion of a diaphragm of the plurality of diaphragms.

8. The apparatus of claim 7, wherein the rigid plate limits a free area of the diaphragm of the plurality of diaphragms.

9. The apparatus of claim 5, wherein the free area of at least one of the plurality of diaphragms has an asymmetric shape.

10. The apparatus of claim 1, wherein at least one diaphragm of the plurality of diaphragms comprises a coating selected from the group consisting of: a hydrophobic coating and an ultraviolet-light-resistant coating.

11. An apparatus comprising:

a sound inlet;

a water-resistant passive vibration cancellation system; and a closed cavity volume at least partially defined by the sound inlet and the water-resistant passive vibration cancellation system, wherein the water-resistant passive vibration cancellation system is arranged such that, when subjected to a vibration that causes vibration deflection of the water-resistant passive vibration cancellation system, a net volume change of the closed cavity volume as a result of the vibration deflection is negligible; and wherein the water-resistant passive vibration cancellation system is further arranged such that, when subjected to an acoustic input that causes acoustic deflection of the water-resistant passive vibration cancellation system, the net volume change of the closed cavity volume as a result of the acoustic deflection is non-negligible.

12. The apparatus of claim 11, wherein the water-resistant passive vibration cancellation system comprises at least one membrane.

13. The apparatus of claim 12, wherein resonance frequencies of the at least one membrane exceed 4 kHz.

14. The apparatus of claim 12, wherein the at least one membrane comprises a resilient material selected from the group consisting of: silicone, rubber, and thermoplastic elastomer.

15. The apparatus of claim 12, wherein the at least one membrane defines a free area having a form factor that resists occurrence of resonance peaks within a speech frequency range.

16. The apparatus of claim 12, wherein the at least one membrane has a close tolerance to the dimensions of a support structure to limit stretching of the at least one membrane.

17. The apparatus of claim 11, wherein the water-resistant passive vibration cancellation system further comprises a rigid plate aligned with the sound inlet.

18. An apparatus comprising:

a housing;

a sound-receiving component disposed in the housing; and a water-resistant passive vibration cancellation system comprising a plurality of diaphragms defining a closed cavity volume, wherein the diaphragms are configured to deform in opposite directions and cause a non-negligible change in a volume of the closed cavity volume when acted on by sound; and wherein the diaphragms are configured to deform in a same direction and cause a negligible change in the volume of the closed cavity volume when acted upon by vibrations.

19. The apparatus of claim 18, further comprising:

a frame supporting the water-resistant passive vibration cancellation system; and a collar extending from the frame, wherein the collar is connected to a structure so as to suspend the sound-receiving component and the water-resistant passive vibration cancellation system relative to the housing.

20. The apparatus of claim 18, wherein at least one of the plurality of diaphragms comprises a rigid plate.

* * * * *